US005388500A

United States Patent [19]

Petrovich

[11] Patent Number: 5,388,500

[45] Date of Patent: Feb. 14, 1995

[54] DELAYED BLOW-BACK FOR FIREARMS

[76] Inventor: Paul A. Petrovich, 11269 Judd Rd., Fowlerville, Mich. 48836

[21] Appl. No.: 207,465

[22] Filed: Mar. 7, 1994

[51] Int. Cl.[6] ..... F41A 5/26; F41A 3/62

[52] U.S. Cl. ..... 89/194; 89/193; 89/191.02; 89/192; 89/130; 89/129.01

[58] Field of Search ..... 89/129.01, 129.02, 130, 89/191.01, 191.02, 193, 194

[56] References Cited

U.S. PATENT DOCUMENTS

| | | | |
|---|---|---|---|
| 2,409,225 | 10/1946 | Schaich | 42/3 |
| 2,865,256 | 12/1958 | Marsh | 89/191 |
| 2,956,481 | 10/1960 | Barr et al. | 89/129 |
| 3,101,648 | 8/1963 | Walther | 89/183 |
| 3,650,177 | 3/1972 | Hupp et al. | 89/130 |

*Primary Examiner*—Charles T. Jordan
*Assistant Examiner*—Christopher Keith Montgomery
*Attorney, Agent, or Firm*—Peter A. Taucher; David L. Kuhn

[57] ABSTRACT

Applicant's device improves rapidly firing guns. When such a gun fires, applicant's device delays departure of the gun bolt from the chamber or barrel zone holding a spent round's casing until barrel pressure drops to a safe level. The device has a hollow piston which is translatable fore and aft along the barrel and which has an orifice communicated to a duct from an inner barrel diameter to an outer barrel diameter. The duct slants forward toward the gun muzzle in a radially outward direction so as to direct expanding propellant gas from the barrel against a forward internal surface of the piston. Momentum of the gas keeps the piston in its most forward position and the piston solidly connects to the bolt so that the bolt stays at the chamber when the piston is pressurized. Optionally, the piston may have an escape opening at its aft end so that some of propellant gas entering the piston will be forced rearward, thereby creating an additional forward force on the piston during and immediately after firing of the projectile. Also optionally, the cylindrical wall of the piston flexes outward under blast pressure so as to frictionally against a bore in which the piston translates, thereby additionally retarding piston motion upon firing of the projectile.

10 Claims, 2 Drawing Sheets

DELAYED BLOW-BACK FOR FIREARMS

GOVERNMENT USE

The invention described herein may be manufactured, used and licensed by or for the U.S. Government for governmental purposes without payment to me of any royalty thereon.

BACKGROUND

My invention is an improvement for repeating fire weapons such as automatic pistols or machine guns. In such weapons a rapid cycle recurs wherein a round of ammunition feeds into the gun's chamber, is fired, and a spent ammunition casing is ejected from the chamber. The cycle typically occurs at 600 rounds per minute, although faster rates are common. The gun bolt, which closes the aft end of the chamber during firing, retracts away from the chamber after firing to permit ejection of the spent casing and feeding of a new round into the chamber. In some guns the bolt opens the chamber too quickly after firing, causing premature blow-back wherein high pressure gas from the fired round's propellant shoots too forcefully from the chamber and endangers a person holding the gun. This problem has previously been addressed by mechanisms which slightly delay retraction of the bolt from the chamber so that pressure in the chamber somewhat dissipates through the gun barrel before bolt retraction. Examples of these mechanisms are found on the German Sturmgewehr machine gun and the Heckler & Koch P7 pistol shown respectively at pages 514 and 463 in *Small Arms of the World* (12th ed., U.S. pub 1983, Stackpole Books).

SUMMARY

My device is a blow-back delay mechanism that is lighter, smaller and less complex than prior devices of this kind. My device has a hollow piston translatable on the gun barrel, the piston having a hole open to a duct in the barrel going from the inner barrel diameter to the outer barrel diameter. The duct slants forward toward the gun muzzle so as to direct a pressurized gas stream from the barrel against a forward inner piston surface. Inertial force of the gas holds the piston in its forward position. The piston solidly connects to the bolt, whereby the bolt stays adjacent the chamber when the piston is immobilized by gas action. The aft end of the piston can have an escape opening to cause some of the gas entering the piston to be forced rearward, thereby creating added forward force on the piston just after firing of the projectile. Also, the cylindrical wall of the piston can be flexible so as to bear outward under gas pressure and press frictionally against a bore where the piston translates, thereby inhibiting piston motion after firing of the projectile.

DETAILED DESCRIPTION

Figure 1:
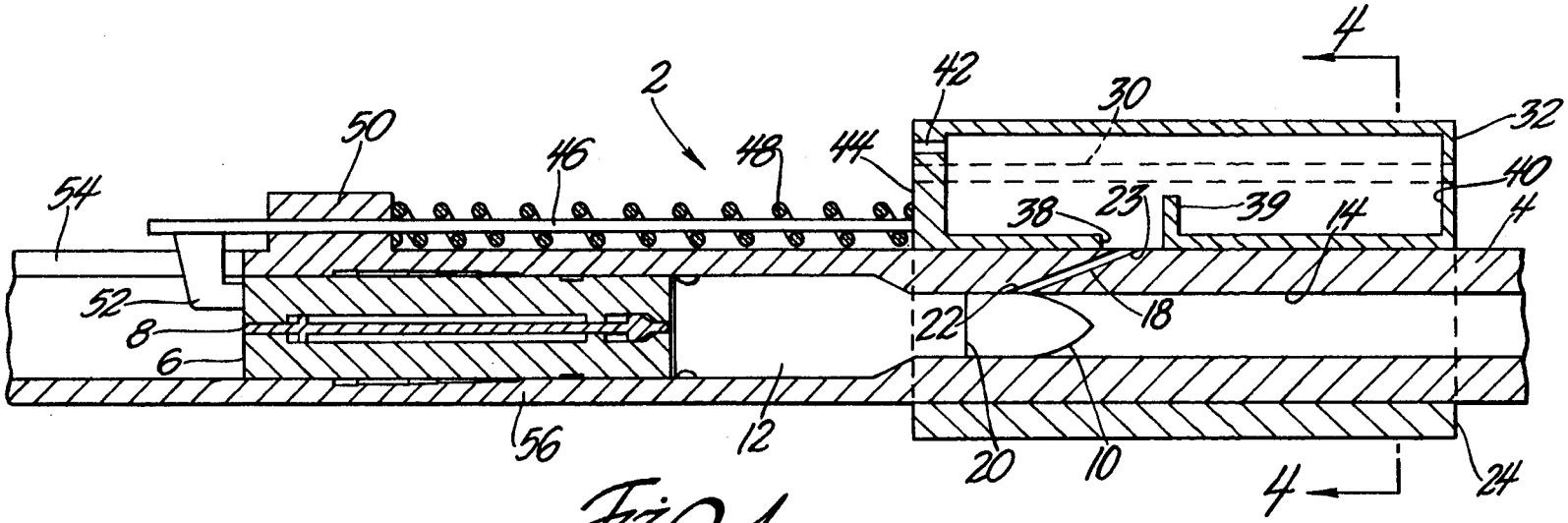
FIG. 1 is an axial sectional view of a gun barrel containing a gun chamber, a bolt and a first embodiment of my blow-back delay device.

In FIG. 1 is a gun's delayed blow-back system 2 mounted to gun barrel 4 forward of the chamber zone containing conventional bolt 6 and conventional firing pin 8. Seated in the chamber of barrel 4, ahead of the bolt, is a conventional projectile having bullet 10 and casing 12 filled with suitable propellant. Barrel 4 defines a duct 18 from barrel inner diameter 14 to barrel outer diameter 16, the duct slanted forward in a radially outward direction relative to the barrel. The inner diametrical end 22 of duct 18 opens forward of the front edge 20 of casing 12, and the outer diametrical end 23 opens to piston 32.

Figure 4:
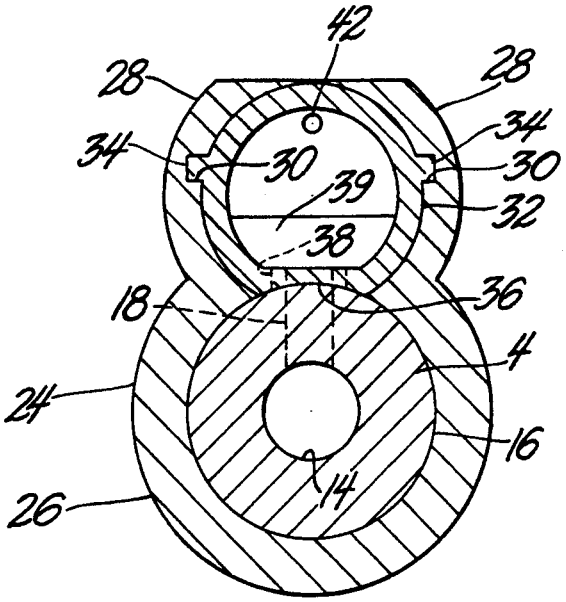
FIG. 4 is a view taken along line 4—4 in FIG. 1.

As seen in FIGS. 1 and 4, there is fixed on barrel 4 a piston guide 24, whose lower, essentially tubular portion 26 is welded, pinned or otherwise fastened to barrel 4. Integral with tubular portion 26 are opposed concave retainers 28 which define a pair of key ways 30. Essentially cylindrical hollow piston 32 fits closely and slidingly between the retainers, the piston having elongate keys 34 engaged in key ways 30. Piston 32 defines an outer concavity 36 that sealingly rides against a portion of outer diameter 16 of barrel 4, the piston having at concavity 36 a slot 38 by which the interior of the piston is communicated to duct 18. An optional deflector or semi-wall 39 can be placed adjacent the front of slot 38 so that a gas stream entering the piston through duct 18 will impact the deflector. Piston 32 has a solid, unapertured fore wall 40 and defines through bore 42 in aft wall 44. Optionally piston 32 can be shortened so that fore wall 40 is at the position of deflector 39 and the deflector is eliminated.

In FIG. 1, the front of rod 46 is fixed to piston 32 and is surrounded by a coil spring 48, the front end of the spring also being fixed to piston 32. Spring 48 moves relative to rod 46, is under light tension during the FIG. 1 position, and is attached at its aft end to boss 50. Boss 50 is either fixedly mounted to barrel for or may be integral therewith as shown in FIG. 1. Rod 46 fits closely through boss 50 and translates therethrough in concert with axial motion of piston 32. A solid connection between rod 46 and bolt 6 is achieved by any suitable means such as dog leg 52, whereby bolt 6, rod 46 and piston 32 translate together as a unit. Barrel 4 has a slot 54 which accommodates the translational motion of dog leg 52.

When firing pin 8 strikes casing 12, the propellant therein explodes, driving bullet 10 through barrel 4 in conventional fashion. After bullet 10 travels forward past duct 18 but before bullet 10 exits barrel 4, high pressure gas resulting from the exploded propellant shoots through duct 18 into piston 32. A stream of gas strikes deflector 39 and the stream's momentum creates a first forward force on the piston and also pressurizes the piston. Gas exits the piston via bore 42 and a pressure differential is created between walls 40 and 44, whereby a second forward force is exerted upon piston 32. The aforementioned first and second forces keep piston 32 in its rightmost, FIG. 1 position while bullet 10 is in barrel 4 and barrel pressure is high.

After bullet 10 exits barrel 4, the gas within the barrel begins to escape and barrel pressure falls, whence pressurized gas in piston 32 travels back to barrel 4 via duct 18. The first force disappears and the second force abates until barrel pressure lowers to a predetermined safe level. Then the tension of spring 48 can pull piston 32, rod 46 and bolt 6 to the left in FIG. 1. Residual blow-back pressure in the barrel now forces casing 12 aft along with bolt 6 in barrel 4, so that casing 12 arrives at region 56, where the casing is ejected from the barrel through a suitable orifice (not shown). In addition to the effect of the residual pressure, there will be a stream of gas returning from piston 32 through duct 18, the momentum of this stream assisting the rearward movement of casing 12. The effect of the concerted action of piston 32, rod 46 and spring 48 is to hold bolt 6 in its firing position shown in FIG. 1 until post-firing barrel pressure is at a safe level.

Figure 2:
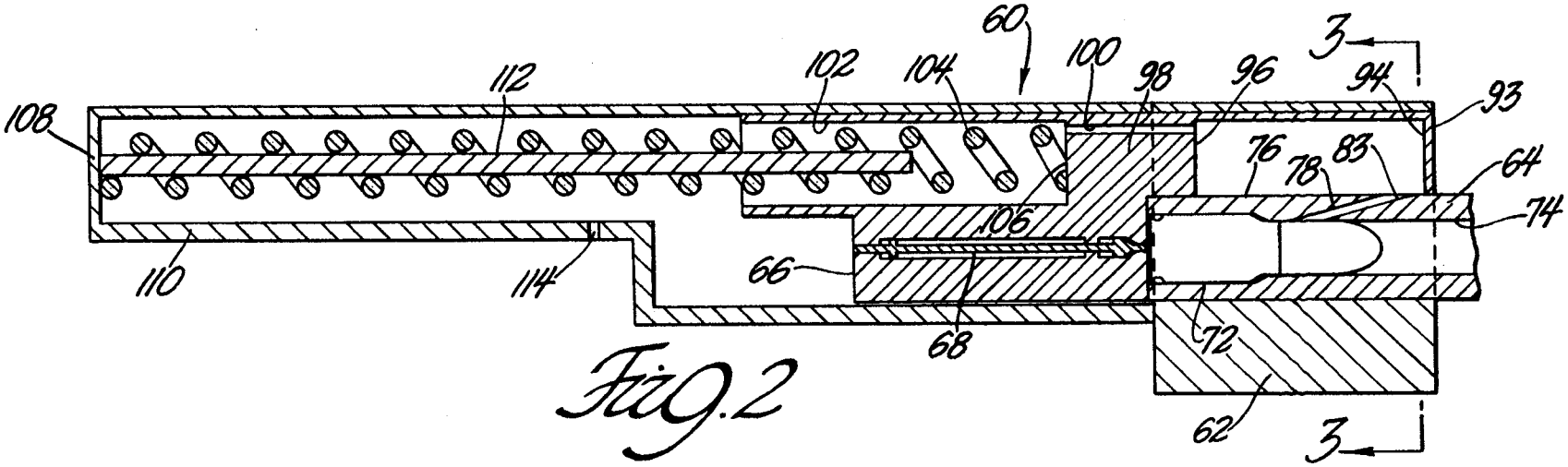
FIG. 2 is an axial sectional view of another gun barrel containing a gun chamber, a bolt and a second embodiment of my blow-back delay device.

In FIG. 2 is an alternate delayed blow-back system 60 where piston carrier 62 is concentrically affixed to gun barrel 64 forward of specially modified bolt 66 and suitable known firing pin 68 in the bolt. Seated in the chamber portion of barrel 64, directly ahead of the bolt 66, is a known projectile having bullet 70 and casing 72 filled with propellant. Barrel 64 defines a straight slanted duct 78 extending from the barrel's inner diameter 74 to the barrel's outer diameter 76, the duct slanted forward in a radially outward direction relative to the barrel. The inner diametrical end 82 of duct 78 opens forward of the front edge 80 of casing 72 and the outer diametrical end 83 opens to piston 93 at or near front inner peripheral piston surface 94.

Figure 3:
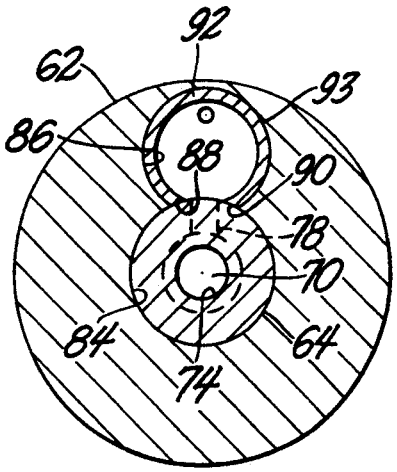
FIG. 3 is a view taken along line 3—3 in FIG. 2.

As seen in FIG. 3, carrier 62 has two parallel diametrically overlapped bores 84 and 86, bore 84 accommodating barrel 64 and bore 86 accommodating hollow piston 93. Piston 93 preferably has at least a mainly or quasi cylindrical wall configuration such as that shown at 92 in FIG. 3. Piston 93 closely fits in and translates in bore 86 and also sealingly slides on the exterior of barrel 64 at interfaces 88 and 90. Between the interfaces 88 and 90 is an axially oriented, elongate gap in cylindrical wall 92. As later discussed along with FIG. 5, one may want wall 92 to be flexible. If so, then it may also be desired that the slot run the entire length of the piston so as to more fully lessen the rigidity of wall 92.

The aft inner peripheral surface 96 of piston 93 is formed by extension block 98, which is integral with bolt 66, and an escape conduit 100 runs through block 98 from piston 93. Also integral with extension block 98 is blind bore 102 communicating to escape conduit 100 and receiving coil spring 104, which is under tension in FIG. 2. The forward end of spring 104 is fixed to extension block 98 and the aft end of the spring is fixed to rearward end 108 of housing 110. Affixed coaxially with spring 104 to end 108 is guide shaft 112 extending partly into blind bore 102. Housing 110 optionally has an escape port 114 disposed aft of extension block's most forward position, which is shown in FIG. 1.

When firing pin 68 hits casing 72, propellant in the casing explodes and drives bullet 70 through barrel 64. After bullet 70 passes duct 78 but before it exits the barrel, pressurized gas from the propellant flows through duct 78 into piston 93 so that a gas stream hits inner peripheral wall 94 and exerts a first forward force on piston 93. Gas exits piston 93 via bore 100 to create a pressure differential between surfaces 94 and 96, and thus a second forward force acts on piston 93. The forward forces keep piston 93 in its rightmost, FIG. 2 position while bullet 70 is in barrel 64. Once bullet 70 exits barrel 64, gas therein begins escaping through the muzzle (not shown) and gas in piston 93 returns to barrel 64 via duct 78. Forward force on piston 93 drops until barrel pressure lowers to a predetermined level, whence tension of spring 104 pulls piston extension block 98 in FIG. 2. Residual barrel pressure now forces casing 72 rearward along with bolt 66, so that casing 72 can be ejected from the gun (not shown) of which system 60 is part.

Figure 5:
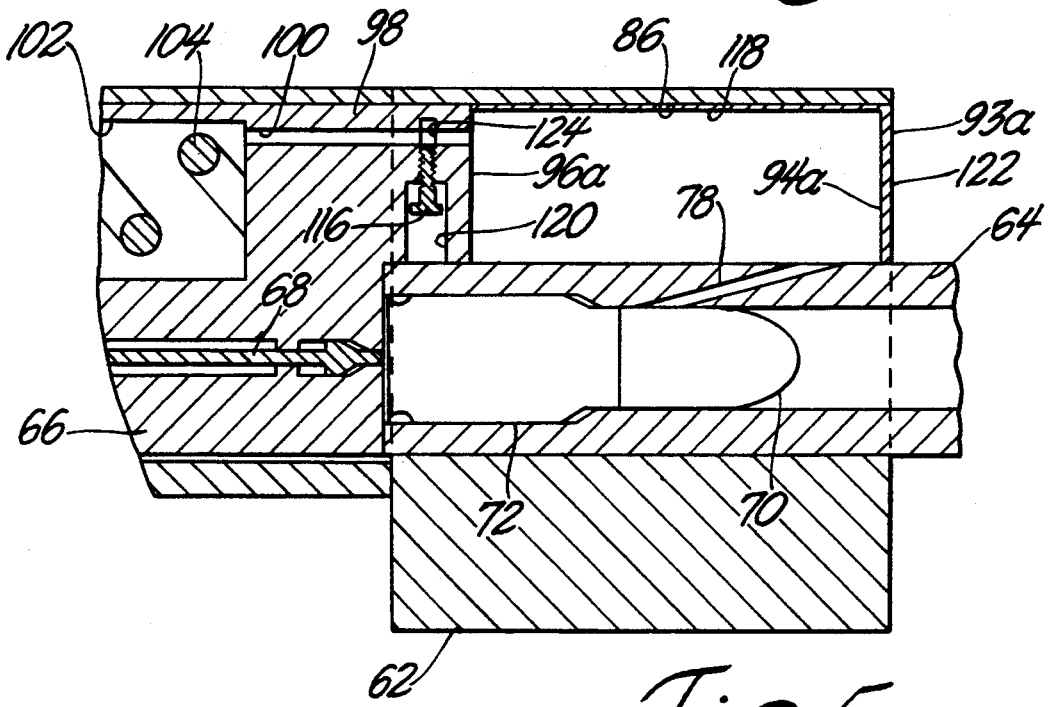
FIG. 5 is a detail sectional view showing optional modifications to the FIG. 2 embodiment.

FIG. 5 is a detail view of an optional modification to the FIG. 2 embodiment where piston 93 is replaced by piston **93*a*. Piston 93*a* has a thinner, more flexible cylindrical wall 118 than does piston 93 and end wall 122 is thinner and less rigid than its counterpart in piston 93. The effect of thinner, more flexible walls in piston 93*a* is that when piston 93*a* receives pressurized gas from barrel 65, piston 93*a* will expand radially at least at its axial midsection, and wall 118 will squeeze against the inner periphery of bore 86. The resulting friction will arrest translation of the piston and thereby prevent bolt 66 from moving until pressure in piston 93*a* lowers to a threshold pressure. Of course, if wall 118 already closely fits in bore 86 before piston 93*a* is pressurized, then wall 118** will not flex, but will merely press harder against the bore's surface when the piston is pressurized, whereby again piston translation is arrested.

Also shown in FIG. 5 is an optional adjustment screw 116 within stepped bore 120 in extension block 98. A smaller diameter portion 124 of the stepped bore intersects escape conduit 100 so that advancing screw 116 deeper into bore 120 will increasingly obstruct and ultimately close conduit 100. Increased obstruction of conduit 100 not only increases pressure in piston **93*a* when propellant in casing 72 explodes but also maintains pressure in piston 93*a* for a longer time. Consequently, greater obstruction of conduit 100 prolongs the delay from when a projectile is fired to when bolt 66 translates away from its FIG. 5 position adjacent barrel 64**.

I wish it to be understood that I do not desire to be limited to the exact details of construction or method shown herein since obvious modifications will occur to those skilled in the relevant arts without departing from the spirit and scope of the following claims.

What is claimed is:

1. In a rapidly repeating firearm having a barrel and a bolt translatable to a position immediately behind a projectile before firing thereof, a device to delay departure of the bolt from the position after firing the projectile, comprising:

a piston translatable along the barrel, the piston defining a cavity therein and defining an orifice communicated with both the cavity and the barrel;

an internal surface of the piston at the orifice the barrel defining a duct from an inner barrel diameter to an outer barrel diameter, the duct communicating with the orifice, the duct slanting away from the bolt in a radially outward direction and opening toward the internal surface;

means fixedly mounted to the barrel for holding the piston;

means for solidly connecting the piston to the bolt; and means for biasing the bolt away from the position immediately behind the projectile.

2. The device of claim 1 wherein the piston further comprises:

a first end;

a second end closer to the bolt than the first end; and means in the second end for allowing pressurized fluid in the piston to escape therefrom in a direction away from the first end.

3. The device of claim 2 wherein the allowing means is an opening through the second end.

4. The device of claim 1 further including:

a first zone of the barrel adapted to receive a casing portion of the projectile;

a second zone of the barrel adjacent the first zone, the second zone adapted to receive a bullet portion of the projectile; and a barrel inner diametrical opening of the duct in the second zone.

5. The device of claim 1 wherein the means for holding the piston defines:

a first bore receiving the barrel; and a second bore parallel to the first bore and overlapped therewith, the second bore receiving the piston.

6. The device of claim 5 wherein the means for holding the piston is an integral body defining the bores therein.

7. The device of claim 1 wherein:

the piston has an at least mainly cylindrical wall;

the orifice is an elongate slot in and along the cylindrical wall; and edges of the slot sealingly engage and slide upon an outer diameter of the barrel.

8. The device of claim 1 wherein the piston has at least a mainly cylindrical wall and the wall is flexible.

9. The device of claim 8 wherein the slot runs the length of the cylindrical wall.

10. The device of claim 1 wherein the piston further comprises:

a first end;

a second end closer to the bolt than the first end;

escape means in the second end for allowing pressurized fluid in the piston to escape therefrom in a direction away from the first end, the escape means comprising an opening through the second end; and means for variably restricting the opening through the second end.

* * * * *